US005267803A

United States Patent [19]

Cappotto

[11] Patent Number: 5,267,803

[45] Date of Patent: * Dec. 7, 1993

[54] CASSETTE HAVING COMPATIBILITY ARRANGEMENT

[75] Inventor: Samuel D. Cappotto, Syracuse, N.Y.

[73] Assignee: Smith Corona Corporation, Cortland, N.Y.

[ * ] Notice: The portion of the term of this patent subsequent to Nov. 20, 2007 has been disclaimed.

[21] Appl. No.: 973,415

[22] Filed: Nov. 9, 1992

Related U.S. Application Data

[63] Continuation of Ser. No. 777,680, Oct. 15, 1991, abandoned, which is a continuation of Ser. No. 614,026, Nov. 14, 1990, abandoned, which is a continuation of Ser. No. 430,107, Nov. 1, 1989, Pat. No. 4,971,462, which is a continuation of Ser. No. 214,982, Jul. 5, 1988, abandoned, which is a continuation-in-part of Ser. No. 126,152, Nov. 30, 1987, Pat. No. 4,900,171.

[51] Int. Cl.[5] ..... B41J 35/28

[52] U.S. Cl. ..... 400/208; 400/697.1

[58] Field of Search ..... 400/194-196.1, 400/206-208.1, 214, 222, 232-234, 249, 240-240.4, 54, 695-697.1

[56] References Cited

U.S. PATENT DOCUMENTS

| | | |
|---|---|---|
| D. 234,633 | 3/1975 | Bellini . |
| D. 253,239 | 10/1979 | Lenney et al. . |
| D. 253,312 | 10/1979 | Lenney et al. . |
| D. 253,354 | 11/1979 | Lenney et al. . |
| D. 289,529 | 4/1987 | Cappotto et al. . |
| 3,348,650 | 10/1967 | Meinherz et al. . |
| 3,503,483 | 3/1970 | Santo . |
| 3,677,486 | 7/1972 | Findlay . |
| 3,695,410 | 10/1972 | Kapp . |
| 3,731,781 | 5/1973 | Caudill et al. . |
| 3,904,017 | 9/1975 | Frechette . |
| 3,923,141 | 12/1975 | Hengelhaupt . |
| 3,977,511 | 8/1976 | Hengelhaupt . |
| 4,131,372 | 12/1978 | Hengelhaupt . |
| 4,213,715 | 7/1980 | Haftmann et al. . |
| 4,239,107 | 12/1980 | Boyatt, Jr. et al. . |
| 4,247,210 | 1/1981 | Kacmarcik et al. . |
| 4,261,527 | 4/1981 | Sims et al. . |
| 4,302,118 | 11/1981 | Schaefer . |
| 4,329,072 | 5/1982 | Kacmarcik . |
| 4,347,007 | 8/1982 | Schaefer . |
| 4,350,452 | 9/1982 | Dials et al. . |
| 4,350,453 | 9/1982 | Field et al. . |
| 4,352,578 | 10/1982 | Dunning et al. . |
| 4,353,657 | 10/1982 | Schaefer . |
| 4,367,963 | 1/1983 | Daughters . |
| 4,395,149 | 7/1983 | Longrod . |
| 4,396,305 | 8/1983 | Shattuck et al. . |
| 4,397,575 | 8/1983 | Aldrich . |
| 4,402,621 | 9/1983 | Abell, Jr. et al. . |
| 4,407,593 | 10/1983 | Haftmann . |
| 4,408,914 | 10/1983 | Ciesiel et al. . |

(List continued on next page.)

FOREIGN PATENT DOCUMENTS

| | | |
|---|---|---|
| 0048418 | 3/1982 | European Pat. Off. . |
| 138715 | 2/1903 | Fed. Rep. of Germany . |
| 1474638 | 8/1969 | Fed. Rep. of Germany . |
| 1611454 | 6/1970 | Fed. Rep. of Germany . |
| 1934271 | 9/1970 | Fed. Rep. of Germany . |
| 2019648 | 11/1971 | Fed. Rep. of Germany . |

OTHER PUBLICATIONS

IBM Wheelwriter Lift-Off Tape Cassette, Quill Catalog, p. 128.

(List continued on next page.)

*Primary Examiner*—Eugene H. Eickholt

[57] ABSTRACT

An arrangement for assuring ink ribbon and correction tape compatibility in a device which utilizes a first cassette having an ink ribbon therein and second cassette having a correction tape therein in the operation thereof, the arrangement including engaging formations located on the first and second cassettes which ensure that the ink ribbon and correction tape are functionally compatible with each other when the respective cassettes are inserted in the device such as, for example, functional compatibility between a single-strike ink ribbon and a lift-off correction tape, or functional compatibility between a multiple-strike ink ribbon and a cover-up correction tape.

20 Claims, 3 Drawing Sheets

FOREIGN PATENT DOCUMENTS

| | | |
|---|---|---|
| 4,472,074 | 9/1984 | Gabler . |
| 4,475,829 | 10/1984 | Goff, Jr. et al. . |
| 4,511,903 | 4/1985 | Miyazaki et al. . |
| 4,516,137 | 5/1985 | Yasui . |
| 4,564,303 | 1/1986 | Rosenberg et al. . |
| 4,606,662 | 8/1986 | Komplin . |
| 4,611,936 | 9/1986 | Yasui . |
| 4,611,938 | 9/1986 | Rettke et al. . |
| 4,616,236 | 10/1986 | Watanabe et al. . |
| 4,616,945 | 10/1986 | Komplin . |
| 4,636,097 | 1/1987 | Goubeaux . |
| 4,650,351 | 3/1987 | Engle et al. . |
| 4,655,623 | 4/1987 | Gasser . |
| 4,662,766 | 5/1987 | Teichmann et al. . |
| 4,669,902 | 6/1987 | Ukmar et al. . |
| 4,676,678 | 6/1987 | Watanabe . |
| 4,678,353 | 7/1987 | Richardson et al. . |
| 4,694,305 | 9/1987 | Shiomi et al. . |
| 4,728,208 | 3/1988 | Iwase . |
| 4,733,980 | 3/1988 | Tosa . |
| 4,747,714 | 5/1988 | Moritz et al. . |
| 4,750,007 | 6/1988 | Suzuki . |
| 4,780,010 | 10/1988 | Behrens et al. . |
| 4,854,027 | 8/1989 | Smith et al. . |
| 4,927,278 | 5/1990 | Kuzuya et al. . |
| 4,944,618 | 7/1990 | Ideta . |
| 4,963,043 | 10/1990 | Durr et al. . |
| 2303877 | 9/1973 | Fed. Rep. of Germany . |
| 2306018 | 11/1973 | Fed. Rep. of Germany . |
| 2328442 | 1/1974 | Fed. Rep. of Germany . |
| 2317971 | 10/1974 | Fed. Rep. of Germany . |
| 2402671 | 7/1975 | Fed. Rep. of Germany . |
| 2705127 | 10/1977 | Fed. Rep. of Germany . |
| 2642069 | 3/1978 | Fed. Rep. of Germany . |
| 3346482 | 7/1984 | Fed. Rep. of Germany . |
| 3425953 | 1/1985 | Fed. Rep. of Germany . |
| 3617388 | 10/1987 | Fed. Rep. of Germany . |
| 3617387 | 11/1987 | Fed. Rep. of Germany . |
| 56-21884 | 2/1981 | Japan . |
| 57-178884 | 11/1982 | Japan . |
| 58-179682 | 10/1983 | Japan . |
| 58-191184 | 11/1983 | Japan . |
| 59-70597 | 4/1984 | Japan . |
| 59-71867 | 4/1984 | Japan . |
| 59-78879 | 5/1984 | Japan . |
| 59-93376 | 5/1984 | Japan . |
| 59-120488 | 7/1984 | Japan . |
| 59-222380 | 12/1984 | Japan . |
| 60-19576 | 1/1985 | Japan . |
| 60-49978 | 3/1985 | Japan . |
| 60-183175 | 9/1985 | Japan . |
| 60-210489 | 10/1985 | Japan . |
| 56-144985 | 11/1985 | Japan . |
| 61-22972 | 1/1986 | Japan . |
| 61-29579 | 2/1986 | Japan . |
| 61-31284 | 2/1986 | Japan . |
| 61-54975 | 3/1986 | Japan . |
| 61-66682 | 4/1986 | Japan . |
| 61-121985 | 6/1986 | Japan . |
| 61-146576 | 7/1986 | Japan . |
| 61-229585 | 10/1986 | Japan . |
| 61-274971 | 12/1986 | Japan . |
| 61-274978 | 12/1986 | Japan . |
| 62-25079 | 2/1987 | Japan . |
| 62-74681 | 4/1987 | Japan . |
| 62-92884 | 4/1987 | Japan . |
| 62-121081 | 6/1987 | Japan . |
| 62-174180 | 7/1987 | Japan . |
| 62-292474 | 12/1987 | Japan . |
| 2170778 | 8/1986 | United Kingdom . |

OTHER PUBLICATIONS

Order and Judgment in *Smith Corona Corporation v. Pelikan, Inc., No. 3-90-0479, U.S. Dist. Ct., MD Tenn., Nashville Div., Jan. 9, 1992. (Also published at 784 F Supp. 452).*

IBM Technical Disclosure Bulletin, "Two-Color Cartridge Ribbon System with Correction", Schaefer, vol. 22, No. 6, Nov. 1979, pp. 2327∝2329.

IBM Technical Disclosure Bulletin, "Protective Carton", Dunning et al., vol. 25, No. 4, Sep. 1982, pp. 1944-1945.

IBM Technical Disclosure Bulletin, "Low Cost Cartridge Code Detector", Craft, vol. 25, No. 4, Sep. 1982, pp. 1980-1981.

IBM Technical Disclosure Bulletin, "Page Width Ribbon Cartridge and Drive Mechanism", Thorne, vol. 25, No. 4, Sep. 1982, pp. 2020-2022.

IBM Technical Disclosure Bulletin, "Web-Tension Sensing Devices", Buchholz et al., vol. 25, No. 4, Sep. 1982, pp. 2066-2067.

IBM Technical Disclosure Bulletin, "Constant Head Wrap Tape Drive," Wenner, vol. 25, No. 4, Sep. 1982, p. 2068.

IBM Technical Disclosure Bulletin, "Web-Guiding Stress Functions", Winarski, vol. 25, No. 4, Sep. 1982, p. 2069.

IBM Technical Disclosure Bulletin, "Stuffer Ribbon Cartridge", Purcell, vol. 25, No. 4, Sep. 1982, pp. 2153-2154.

IBM Technical Disclosure Bulletin, "End-Of-Ribbon Sensor and Cartridge-Present Indicator", Jenkins, vol. 27, No. 6, Nov. 1984, pp. 3645-3647.

IBM Technical Disclosure Bulletin, "Printer Ribbon Cartridge Insertion Position Locators," vol. 29, No. 4, Sep. 1986, pp. 1571-1572.

CASSETTE HAVING COMPATIBILITY ARRANGEMENT

This application is a continuation of application Ser. No. 07/777,680, filed Oct. 15, 1991 now abandoned, which is a continuation of application Ser. No. 614,026 now abandoned, filed Nov. 14, 1990, which is a continuation of application Ser. No. 430,107, filed Nov. 1, 1989, now U.S. Pat. No. 4,971,462, which is a continuation of Ser. No. 214,982, filed Jul. 5, 1988, now abandoned, which in turn is a continuation-in-part of Ser. No. 126,152 filed Nov. 30, 1987 and entitled, "Cassette Compatibility" now U.S. Pat. No. 4,900,171.

Statements as to Rights to Inventions Made Under Federally Sponsored Research and Development The invention disclosed and claimed herein was not made under any federally sponsored research and development program.

BACKGROUND OF THE INVENTION (1) Field of the Invention

This invention is directed to cassettes used with devices such as typewriters or text printers which utilize at least two different cassettes, such as a ribbon cassette and a correcting cassette.

(2) Description of the Prior Art

Various prior art devices disclose means by which the operability of a typewriter or printer is controlled by the condition or type of cassette present in the typewriter or printer. U.S. Pat. No. 4,636,097, for example, includes means for rendering the printer inoperable when the end of the typewriter ribbon in a cassette is sensed, or when there is no cassette in the printer. Another such device is disclosed in IBM Technical Disclosure Bulletin, "Low Cost Cartridge Code Detector," Craft, Volume 25, No. 4, September 1982 pp. 1980, 1981. The cassette disclosed therein provides a signal to the device (such as a typewriter) which identifies the contents of the cassette, so that the device may adjust to the characteristics of the cassette contents. Still another such device is disclosed in U.S. Pat. No. 4,516,137 wherein the presence or absence of a thermal ribbon cassette is sensed by the printer. If a thermal ribbon cassette is present, the printer can print only unidirectionally, whereas when the ribbon cassette is not present, the printer prints bi-directionally.

There are, in addition, prior art devices which disclose means for connecting a ribbon cassette to a correcting cassette. Examples of such prior art devices are U.S. Pat. No. 4,239,107 and U.S. Pat. No. 4,302,118. The '118 patent discloses mating formations adapted to place a ribbon cassette in register with a correcting cassette, and also discloses means on the cassette which control the selection of the correct feed and ribbon lift mechanism.

SUMMARY OF THE INVENTION

The present invention is directed to means for making certain that in devices such as typewriters or printers, which may utilize at least two different cassettes, such as a ribbon cassette and a correcting cassette, the cassettes are functionally compatible with each other.

In common practice, a typewriter ribbon cassette includes a plastic jacketing in which the ribbon and various components are conveniently housed. These components may include, among other things, a supply spool upon which a supply of typewriter ribbon is located, mechanism for assuring the uniform withdrawal of ribbon from the supply spool to the typewriter print point, and a take-up spool on which the typed ribbon is located. A typewriter drive mechanism rotates the take-up spool to cause fresh ribbon from the supply spool to advance to the print point. A typewriter ribbon cassette of this type is disclosed in U.S Pat. No. 4,302,118.

Such typewriter ribbon cassettes may contain various types of ribbons. For example, the ribbon may be of the single-strike carbon ribbon type or of the multiple-strike carbon ribbon type. If the ribbon is a single-strike carbon ribbon, the ribbon is incrementally fed in such a manner that upon a single character being typed on a portion of the ribbon, the ribbon is advanced so that the next character is typed on a fresh portion of the ribbon.

If the ribbon is a multiple-strike ribbon, such as the "Multi-Strike" ribbon sold by Smith Corona Corporation, the ribbon is incrementally fed in such a manner that upon a character being typed on a ribbon, the ribbon is advanced a lesser distance so that the next character is typed on a ribbon portion comprising both a typed ribbon portion and a fresh ribbon portion. In this manner, significantly more characters may be typed on a multiple-strike ribbon than on a single-strike ribbon.

A typewriter correcting cassette may also include a plastic jacketing for conveniently housing a correcting tape and various components. As in the typewriter ribbon cassette, the components of a correcting cassette may include a supply spool, means for assuring the uniform withdrawal of correcting tape from the supply spool, and a take-up spool. Here too, the correcting tape may be of two types, namely, the type commonly referred to as "lift-off" tape, in which the tape, upon striking the unwanted character, removes the unwanted character from the paper, or the type commonly referred to as "cover-up" tape, in which, upon the tape striking the unwanted character, a powdered material on the tape is transferred to and covers up the unwanted character on the paper.

In the existing market, with few, if any, exceptions, lift-off correcting tape is primarily compatible with single-strike carbon ribbons, and cover-up correcting tape is primarily compatible with multiple-strike carbon ribbons. Each combination of cassettes having compatible ribbon and correcting tapes may be termed a cassette combination or assembly. Therefore, in a typewriter which permits the use of both single-strike and multiple-strike ribbons as well as both lift-off and cover-up correcting tapes, it is desirable to provide means to assure that the lift-off correcting tape is used only with compatible single-strike carbon ribbons and that the cover-up tape is used only with multiple-strike ribbons. The present invention is directed to means for providing a simple, reliable means to assure that the lift-off tape cassette can be used only with the compatible single-strike ribbon cassette and that the cover-up tape cassette can be used only with the compatible multiple-strike ribbon cassette.

That is achieved, in general, by providing the cassette with means for assuring that the first cassette is functionally compatible with the corresponding second cassette of the combination or assembly upon the cassettes being inserted into a device, such as a typewriter or printer in a system which utilizes the cassettes.

According to the present invention, if it is attempted to utilize a cassette having the foregoing means with a second cassette which is not compatible with that cassette, i.e., of a different cassette combination, the means for assuring cassette compatibility will prevent the first cassette from being properly placed in the device and indicating to the operator that an attempt is being made to place into the device a cassette which is not compatible with another being so placed.

BRIEF DESCRIPTION OF THE DRAWINGS

A further understanding of the present invention may be had when the following detailed description is read in conjunction with the accompanying drawings, in which.

DETAILED DESCRIPTION OF THE PREFERRED EMBODIMENT

Figure 1:
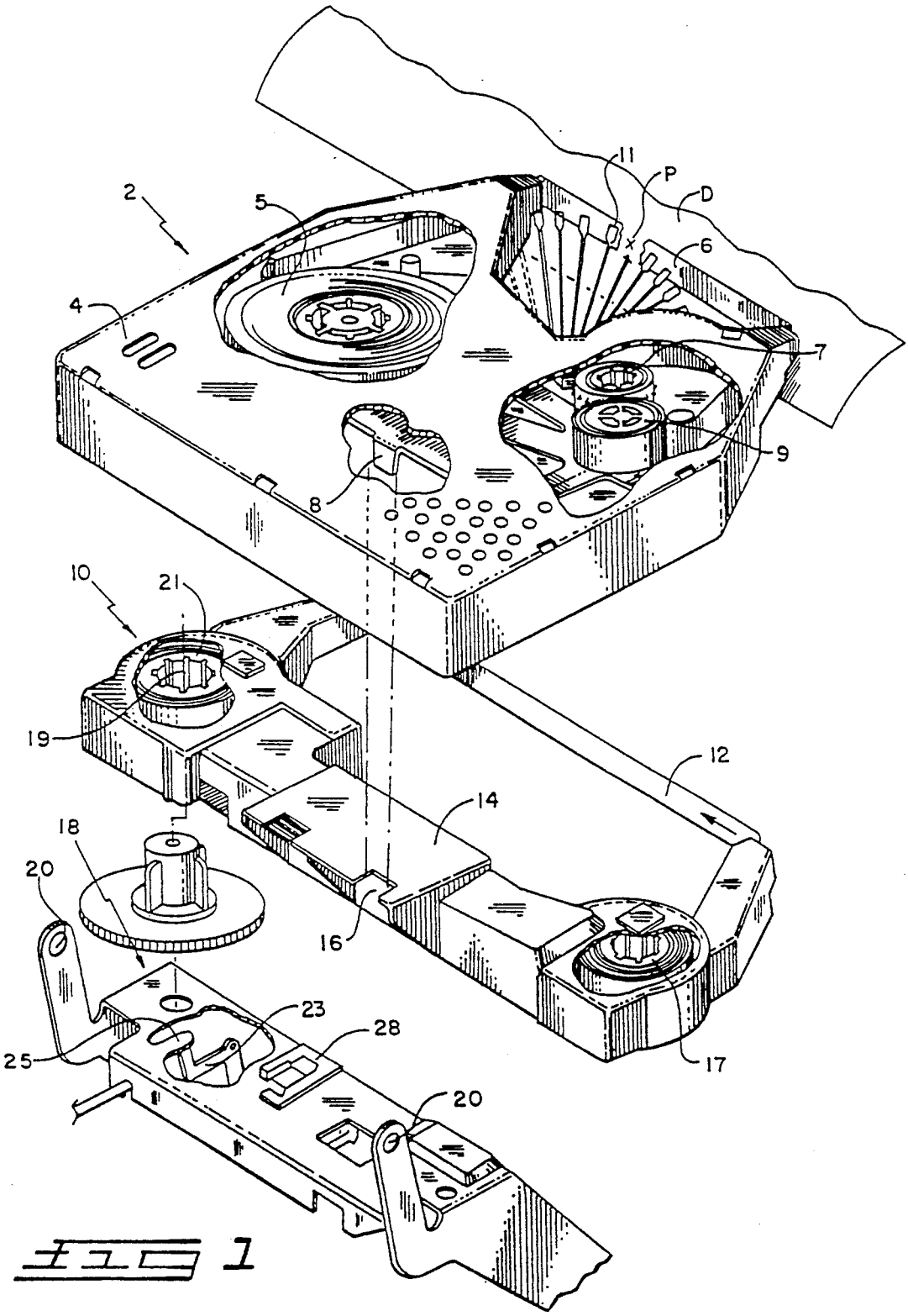
FIG. 1 is an exploded top perspective view of the present invention showing a cassette combination including a first typewriter ribbon cassette, a first correction tape cassette, and a partial view of a shiftable bracket section which carries the ribbon cassette and correction tape thereon.
Figure 3:
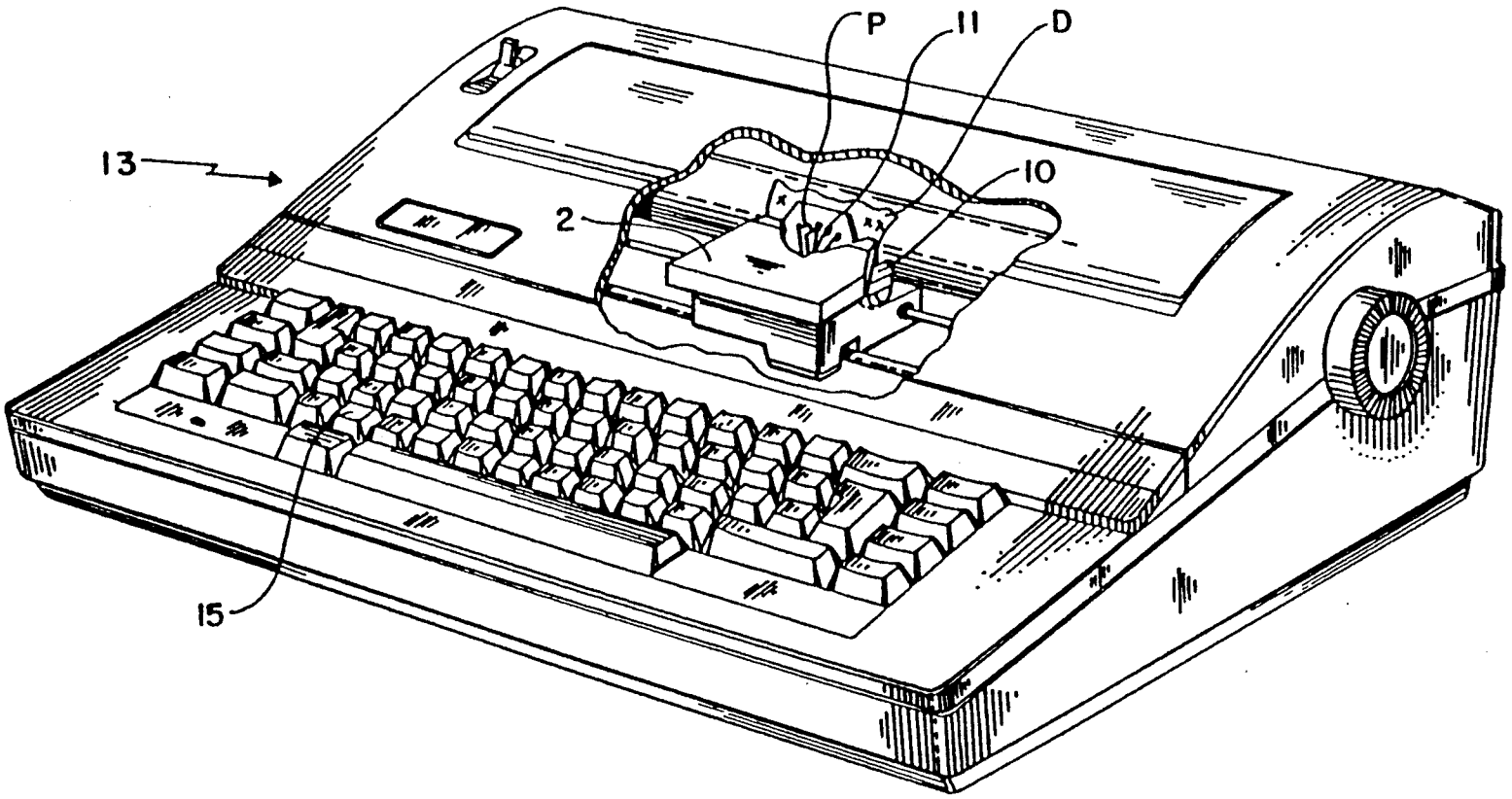
FIG. 3 is a top perspective view of a conventional typewriter within which the present invention may be used.

There is shown in FIG. 1 a first typewriter ribbon cassette 2 having a housing 4 within which a first typewriter ribbon 6 (which may be of the single-strike carbon ribbon type), and various other components, are housed. A formation 8, such as a tab, extends from the right-hand portion of the bottom of the housing 4 for a purpose to be described hereinafter. As noted above, a single-strike carbon ribbon is of the type which is incrementally fed in such a manner that upon a character being typed on a ribbon portion, the ribbon is advanced so that the next character is typed on a fresh portion of the ribbon. These components, may include, among other things, a supply roll 5 upon which a typewriter ribbon supply is located, a mechanism 7 for assuring the uniform withdrawal of ribbon 6 from the supply roll 5 to the typewriter print point P (best seen in FIG. 3), and a take-up spool 9 on which the typed ribbon is located. Such a cassette is presently being sold by Smith Corona Corporation under its "H Correctable" mark.

Also in FIG. 1, there is disclosed a first correction tape cassette 10 which is functionally compatible with the first typewriter ribbon cassette 2, and within which a first correction tape 12 of, for example, the lift-off type, together with other components, is housed. Such a cassette is described in U.S. Pat. No. 4,886,383, issued Dec. 12, 1989, entitled "Tape Cassette for Metering Correction Tape Feed". The ribbon cassette 2 and the functionally compatible correction cassette 10 may be designated a cassette combination or assembly. In operation, to delete an unwanted typed character from a document D, the lift-off tape 12 is raised to the print point P (best seen in FIG. 3) over the character, and the unwanted character on the type element 11 of a typewriter 13 (best seen in FIG. 3) is positioned to strike the lift-off tape 12. Typewriter actuating means such as a typewriter key 15 (best seen in FIG. 3) causes the type element 11 to strike the lift-off tape 12 against the unwanted character on the document D, and the lift-off tape 12 withdraws the unwanted character from the document D.

The components in the first correction tape cassette 10 may include a supply roll 17 of correcting tape 12, means 19 for assuring the uniform withdrawal of correcting tape 12 from the supply roll 17 and a take-up spool 21. The first correction tape cassette 10 also includes a flat portion 14 having a formation 16 illustrated as an opening, in the right-hand portion, through which the tab formation 8 of the first typewriter ribbon cassette 2 extends when the cassettes 2, 10 are inserted into the typewriter 13. As used herein, a functionally compatible cassette is one in which the ink ribbon in the first cassette is functionally compatible with the correction tape in the second cassette.

FIG. 1 further discloses a shiftable bracket section 18 of a typewriter 13 or printer, the section 18 being adapted to operationally accommodate the first typewriter 13 ribbon cassette 2 and the first correction tape cassette 10 thereon. The shiftable bracket section 18 is pivotable about pivot points 20 by conventional typewriter means 23 and 25 for presenting either the first typewriter ribbon 6 or the lift-off first correction tape 12 to the typewriter print point P (best seen in FIG. 3). The engagement of the tab formation 8 of the ribbon cassette 2 with the opening formation 16 of the first correction tape cassette 10 ensures that the cassettes 2, 10 are compatible with each other. The cassettes 2 and 10 are configured so that unless the formations 8 and 16 are in operational engagement, the cassette assembly will not be capable of being inserted in the typewriter 13. Consequently, the typewriter 13 will be inoperable.

Figure 2:
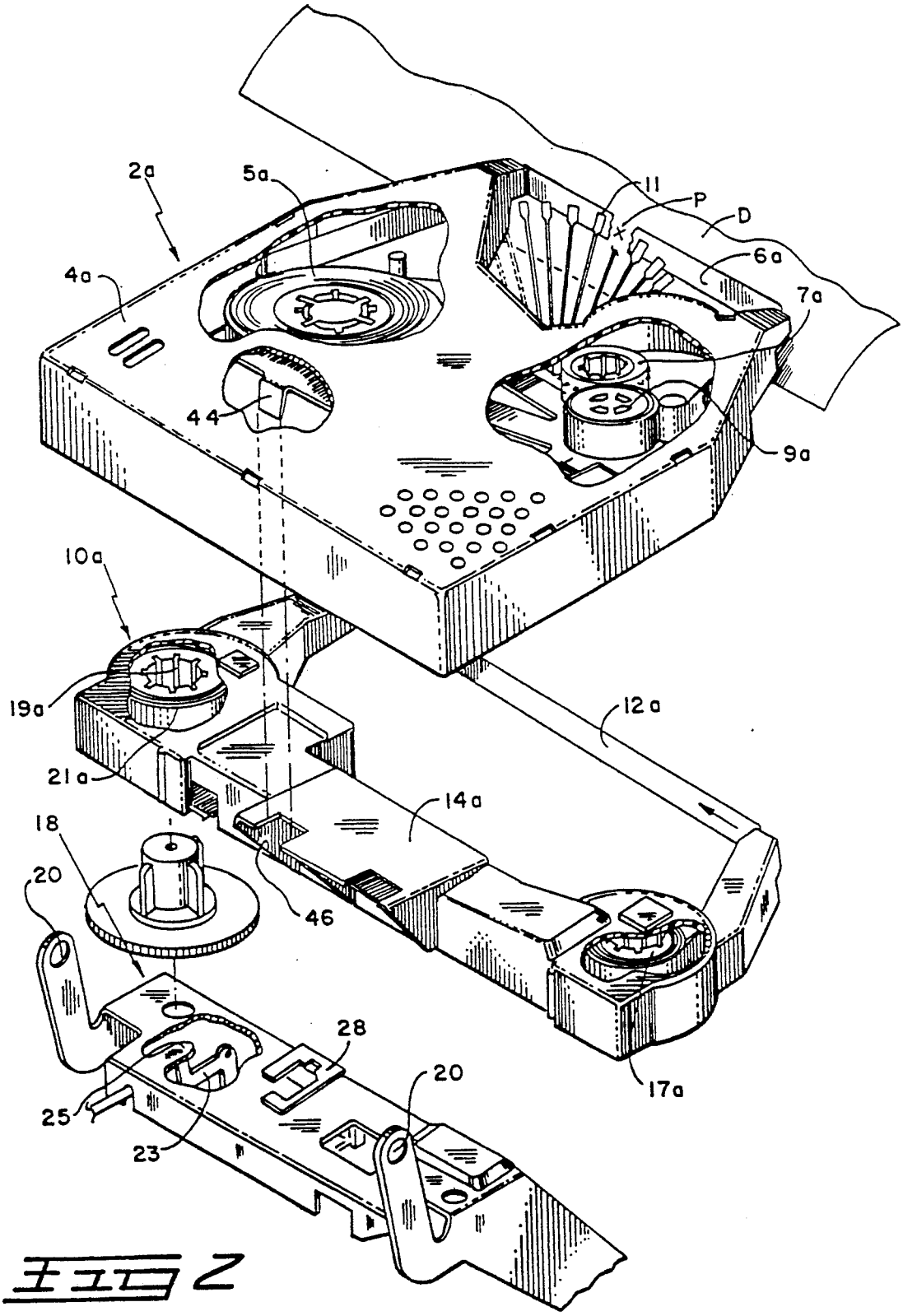
FIG. 2 is an exploded top perspective view of the present invention showing a cassette combination including a second typewriter ribbon cassette, a second correction tape cassette, and a partial view of a shiftable bracket section which carries the ribbon cassette and correction tape thereon

FIG. 2 shows a second typewriter ribbon cassette 2*a* and a second correction tape cassette 10*a* which are generally similar in construction to the first typewriter ribbon cassette 2 and the first correction tape cassette 10 shown in FIG. 1. Therefore, in large part, the same numerical reference numerals will be used in FIG. 2 as were used in FIG. 1, except that the letter "a" will be added to the reference numerals of FIG. 2.

There is shown in FIG. 2 the second typewriter ribbon cassette 2*a* having a housing 4*a* within which a second typewriter ribbon 6*a*, which may be of the multiple-strike carbon ribbon type, and various other components are housed. A formation 44 such as a tab extends from the left-hand portion of the bottom of the housing 4*a* for the purpose to be hereinafter described. As noted above, a multiple-strike carbon ribbon is of the type which is incrementally fed in such a manner that upon a character being typed on a ribbon portion, the ribbon is advanced so that the next character is typed on a ribbon portion comprising both a typed ribbon portion and a fresh ribbon portion. These components may include, among other things, a supply roll 5 upon which a typewriter ribbon supply is located, mechanism 70 for assuring the uniform withdrawal of ribbon 6*a* from the supply roll 5*a* to the typewriter print point P (best seen in FIG. 3), and a take-up spool 9*a* on which the typed ribbon is located. Such a cassette is presently being sold by Smith Corona Corporation under its "H Multi-Strike" mark.

There is further shown in FIG. 2 the second correction tape cassette 10*a* which is functionally compatible with the second typewriter ribbon cassette 2*a*, and within which a second correction tape 12*a* of, for example, the cover-up type, together with other components, is housed. The ribbon cassette 2*a* and the functionally compatible correction cassette 10*a* may be designated a cassette combination or assembly. In operation, to delete an unwanted typed character from a document D, the cover-up tape 12a is raised to the print point P over the character, and the unwanted character on the type element 11 is positioned to strike the cover-up tape 12a. Typewriter actuating means 15 causes the type element 11 to strike the cover-up tape 12a against the unwanted character on the document D, and the cover-up tape 12a is transferred to and covers up the unwanted character.

The components in the second correction tape cassette 10a may include a supply roll 17a of correction tape 12a, means 19a for assuring the uniform withdrawal of correction tape 12a from the supply roll 17a, and a take-up spool 21a. The second correction tape cassette 10a also includes a flat portion 14a having a formation 46 illustrated as an opening in the left-hand portion, through which the tab 44 of the second typewriter ribbon cassette 2a extends when the cassettes 2a, 10a are inserted into the typewriter 13. The shiftable bracket section 18 shown in FIG. 2 is the same bracket section 18 shown in FIG. 1. The engagement of the tab formation 44 of the ribbon cassette 2a with the opening formation 46 of the second correction tape cassette 10a ensures that the cassettes are compatible with each other. The cassettes 2a and 10a are configured so that unless the formations 44 and 46 are in operational engagement, the cassettes 2a, 10a will not be capable of being inserted in the bracket section 18. Consequently, the typewriter 13 will be inoperable.

In operation, downward movement of the tab formation 8, will only occur when the right-hand tab formation 8 can extend through the right-hand opening formation 16 in the flat portion 14 in compatible first correction tape cassette 10. If, however, instead of the first correction tape cassette 10 being present in the typewriter 13, an incompatible correction tape cassette, such as second correction tape cassette 10a, is present, which has no opening or only a left-hand opening formation 46 in the flat portion 14a, the tab formation 8 cannot extend downwardly through the opening, preventing seating of the first cassette 2 on the second correction tape cassette 10a, and immediately indicating to the operator, by the physical interference of tab 8 holding the first cassette 2 above and not squarely against correction tape cassette 10a, that an attempt has been made to place an incompatible cassette into the typewriter 13. Conversely, the combination of the right-hand tab 8 and the right-hand opening 16 or the combination of the left-hand tab 44 and the left-hand opening 46 will assure that the first and second cassettes which are inserted in the device are functionally compatible with each other.

Similarly, with respect to the second typewriter ribbon cassette 2a, proper insertion of the cassette 2a will only occur when the left-hand tab formation 44 can extend through the left-hand opening formation 46 in the flat portion 14a in compatible second correction tape cassette 10a. If, however, instead of second correction tape cassette 10a being present in the typewriter 13, an incompatible first correction tape cassette is present, such as in this case cassette 10, which has only the right-hand opening 16 in the flat portion 14, the tab formation 44 cannot extend downwardly through the opening formation 46, preventing the seating of the second ribbon cassette 2a upon the first correction tape cassette 10. Thus, it will be seen that with respect to the embodiment shown in FIGS. 1 and 2, the typewriter 13 will not be operable when either the first typewriter ribbon cassette 2 and the second correction tape cassette 10a, or the second typewriter ribbon cassette 2a and the first correction tape cassette 10 are present therein.

It is to be understood that the present disclosure of a means for assuring cassette compatibility has been made only by way of example, and that changes in details of construction and the combination and arrangement of parts may be resorted to without departing from the true spirit and scope of the invention as hereinafter claimed.

What is claimed is:

1. A ribbon cassette for use in a system including a device which uses said ribbon cassette and a correction tape cassette selected from at least two types of correction tape cassettes including a first type of correction tape cassette provided with a first type of correction tape which is preferably used with said ribbon cassette, the first type of correction cassette having an externally accessible formation, the types of correction tape cassettes further including a second type of correction tape cassette provided with another type of correction tape which is not preferably used with said ribbon cassette, the second type of correction tape cassette having an externally accessible formation on the first type of correction tape cassette, said ribbon cassette comprising:

a housing which is made at least in part of plastic material;

a first type of ribbon which is preferably used with the first type of correction tape and not preferably used with the second type of correction tape, said ribbon being at least partially disposed in said housing;

said housing having a structural formation which is configured to sufficiently match the externally accessible formation on the first type of correction tape cassette to permit said ribbon cassette and the first type of correction cassette to be used together in the device; and, said structural formation on said housing being configured to sufficiently mismatch the externally accessible formation on the second type of correction cassette to inhibit the use of said ribbon cassette together with the second type of correction tape cassette when placed in the device.

2. The ribbon cassette as defined in claim 1, wherein the first type of correction tape in the first type of correction tape cassette is lift-off correction tape, the second type of correction tape in the second type of correction tape cassette is cover up correction tape, and said ribbon in said ribbon cassette is single-strike ribbon.

3. The ribbon cassette as defined in claim 1, wherein the first type of correction tape in the first type of correction tape cassette is cover-up correction tape, the second type of correction tape in the second type of correction tape cassette is lift-off correction tape, and said ribbon in said ribbon cassette is multiple-strike ribbon.

4. The ribbon cassette as defined in claim 1, wherein the externally accessible formation on the first type of correction tape cassette has a top opening located at a first location, the externally accessible formation on the second type of correction tape cassette has a surface located at a location corresponding to the first location on the first type of correction tape cassette, and wherein said structural formation on said housing of the ribbon cassette includes a bottom provided with a tab, said tap on said bottom of said housing being sized, shaped, and positioned to permit said tab to enter the opening at the first location on the first type of correction tape cassette when said ribbon cassette and the first type of correction tape cassette are inserted into the device to permit use of said ribbon cassette with the first type of correction tape cassette; and, said tab on said bottom of said housing being sized, shaped, and positioned to contact the surface of the top of the second type of correction tape cassette when said ribbon cassette and the second type of correction tape cassette are inserted into the device to inhibit use of said ribbon cassette with the second type of correction tape cassette.

5. The ribbon cassette as defined in claim 4, wherein the first type of correction tape in the first type of correction tape cassette is lift-off correction tape, the second type of correction tape in the second type of correction tape cassette is cover up correction tape, and wherein said ribbon in said ribbon cassette is single-strike ribbon.

6. The ribbon cassette as defined in claim 4, wherein the first type of correction tape in the first type of correction tape cassette is cover-up correction tape, the second type of correction tape in the second type of correction tape cassette is lift-off correction tape, and wherein said ribbon in said ribbon cassette is multiple-strike ribbon.

7. A ribbon cassette for use in a system including a device which uses said ribbon cassette and a correction tape cassettes comprising at least two types of correction tape cassettes including a first type of correction tape cassette provided with lift-off type correction tape, the first type of correction cassette having a structural formation which is accessible from outside the first type of correction tape cassette, the plurality of types of correction tape cassettes further including a second type of correction tape cassette provided with cover-up type correction tape, the second type of correction tape cassette having a structural formation which is accessible from outside the second type of correction tape cassette, the structural formation on the first type of correction tape cassette having at least one difference from the structural formation on the second type of correction tape cassette, said ribbon cassette comprising:

a housing which is made at least in part of plastic material;

a single-strike type ribbon at least partially disposed in said housing;

said housing having a structural formation which is configured to sufficiently match the structural formation on the first type of correction tape cassette to permit said ribbon cassette and the first type of correction cassette to be used together in the device; and, said structural formation on said housing being configured to sufficiently mismatch the structural formation on the second type of correction cassette to inhibit the use of said ribbon cassette together with the second type of correction tape cassette when placed in the device.

8. A ribbon cassette for use in a system including a device which uses said ribbon cassette and a correction tape cassette selected from a plurality of types of correction tape cassettes comprising at least two types of correction tape cassettes including a first type of correction tape cassette provided with lift-off type correction tape, the first type of correction tape cassette having a top with an opening located at a first location, the plurality of types of correction tape cassettes further including a second type of correction tape cassette provided with cover-up type of correction tape, the second type of correction tape cassette having a top with a surface located at a location corresponding to the first location on the first type of correction tape cassette, said ribbon cassette comprising:

a housing having a bottom with a tab, said housing being made at least in part of plastic material;

a ribbon at least partially disposed in said housing, said ribbon being of the single-strike type;

said tab on said bottom of said housing being sized, shaped, and positioned to permit said tab to enter the opening at the first location on the first type of correction tape cassette when said ribbon cassette and the first type of correction tape cassette are inserted into the device so as to permit use of said ribbon cassette with the first type of correction tape cassette; and, said tab on said bottom of said housing being sized, shaped, and positioned to contact the surface of the top of the second type of correction tape cassette when said ribbon cassette and the second type of correction tape cassette are inserted into the device so as to inhibit use of said ribbon cassette with the second type of correction tape cassette.

9. A ribbon cassette for use in a system including a device which uses said ribbon cassette and a correction tape cassette selected from a plurality of types of correction tape cassettes comprising at least two types of correction tape cassettes including a first type of correction tape cassette provided with cover-up type correction tape, the first type of correction cassette having a structural formation which is accessible from outside the first type of correction tape cassette, the plurality of types of correction tape cassettes further including a second type of correction tape cassette provided with lift-off type correction tape, the second type of correction tape cassette having a structural formation which is accessible from outside the second type of correction tape cassette, the structural formation on the first type of correction tape cassette having at least one difference from the structural formation on the second type of correction tape cassette, said ribbon cassette comprising:

a housing which is made at least in part of plastic material;

a multiple-strike type ribbon at least partially disposed in said housing;

said housing having a structural formation which is configured to sufficiently match the structural formation on the first type of correction tape cassette to permit said ribbon cassette and the first type of correction cassette to be used together in the device; and, said structural formation on said housing being configured to sufficiently mismatch the structural formation on the second type of correction cassette to inhibit the use of said ribbon cassette together with the second type of correction tape cassette when placed in the device.

10. A ribbon cassette for use in a system including a device which uses said ribbon cassette and a correction tape cassette selected from a plurality of types of correction tape cassette comprising at least two types of correction tape cassettes including a first type of correction tape cassette provided with cover-up type correction tape, the first type of correction tape cassette having a top with an opening located at a first location, the plurality of types of correction tape cassettes further including a second type of correction tape cassette provided with lift-off type of correction tape, the second type of correction tape cassette having a top with a surface located at location corresponding to the first location on the first type of correction tape cassette, said ribbon cassette comprising:

a housing having a bottom with a tab, said housing being made at least in part of plastic material;

a ribbon at least partially disposed in said housing, said ribbon being of the multiple-strike type; and said tab on said bottom of said housing being sized, shaped, and positioned to permit said tab to enter the opening at the first location on the first type of correction cassette when said ribbon cassette and the first type of correction tape cassette are inserted into the device so as to permit use of said ribbon cassette with the first type of correction tape cassette; and, said tab on said bottom of said housing being sized, shaped, and positioned to contact the surface of the top of the second type of correction tape cassette when said ribbon cassette and the second type of correction tape cassette are inserted into the device so as to inhibit use of said ribbon cassette with the second type of correction tape cassette.

11. A correction tape cassette for use in a system including a device which uses said correction tape cassette and a ribbon cassette selected from at least two types of ribbon cassettes including a first type of ribbon cassette provided with a first type of ribbon which is preferably used with said correction tape cassette, the first type of ribbon cassette having an externally accessible formation, the types of ribbon cassettes further including a second type of ribbon cassette provided with a second type of ribbon which is not preferably used with said correction tape cassette, the second type of ribbon cassette having an externally accessible formation having at least one structural difference from the externally accessible formation on the first type of ribbon cassette, said correction tape cassette comprising:

a housing which is made at least in part of plastic material;

a first type of correction tape which is preferably used with the first type of ribbon in the first type of ribbon cassette and not preferably used with the second type of ribbon, said correction tape being at least partially disposed in said housing;

said housing having a structural formation which is configured to sufficiently match the externally accessible formation on the first type of ribbon cassette to permit said correction tape cassette and the first type of ribbon cassette to be used together in the device; and, said structural formation on said housing being configured to sufficiently mismatch the externally accessible formation on the second type of ribbon cassette to inhibit the use of said correction tape cassette together with the second type of ribbon cassette when placed in the device.

12. The correction tape cassette as defined in claim 11, wherein the first type of ribbon in the first type of ribbon cassette is single-strike ribbon, the second type of ribbon in the second type of ribbon cassette is multiple-strike ribbon, and wherein said correction tape in said first type of correction tape cassette is lift-off correction tape.

13. The correction tape cassette as defined in claim 11, wherein the first type of ribbon in the first type of ribbon cassette is multiple-strike ribbon, the second type of ribbon in the second type of ribbon cassette is single-strike ribbon, and wherein said correction tape in said correction tape cassette is cover-up correction tape.

14. The correction tape cassette as defined in claim 11, wherein the externally accessible formation on the first type of ribbon cassette has a bottom with a tab located at a first location, the externally accessible formation on the second type of ribbon cassette has a bottom with a tab located at a second location different from the first location on the first type of ribbon cassette, and wherein said structural formation on said housing of said correction cassette includes a top with a surface having an opening, said opening being sized, shaped, and positioned to permit the tab on the first type of ribbon cassette to enter said opening when said correction tape cassette and the first type of ribbon cassette are inserted into the device to permit use of said cassette tape cassette with the first type of ribbon cassette; and, said surface of said top of said housing being configured to contact the tab on the second type of ribbon cassette when said correction tape cassette and the second type of ribbon cassette are inserted into the device to inhibit use of said correction tape cassette with the second type of ribbon cassette.

15. The correction tape cassette as defined in claim 14, wherein the first type of ribbon in the first type of ribbon cassette is single-strike ribbon, the second type of ribbon in the second type of ribbon cassette is multiple-strike ribbon, and wherein said correction tape in said first type of correction tape cassette is lift-off correction tape.

16. The correction tape cassette as defined in claim 14, wherein the first type of ribbon in the first type of ribbon cassette is multiple-strike ribbon, the second type of ribbon in the second type of ribbon cassette is single-strike ribbon, and wherein said correction tape in said correction tape cassette is cover-up correction tape.

17. A correction tape cassette for use in a system including a device which uses said correction tape cassette and a ribbon cassette selected from a plurality of types of ribbon cassettes comprising at least two types of ribbon cassettes including a first type of ribbon cassette provided with single-strike type ribbon, the first type of ribbon cassette having a structural formation which is accessible from outside the first type of ribbon cassette, the plurality of types of ribbon cassettes further including a second type of ribbon cassette provided with multiple-strike type ribbon, the second type of ribbon cassette having a structural formation which is accessible from outside the second type of ribbon cassette, the structural formation on the first type of ribbon cassette having at least one difference from the structural formation on the second type of ribbon cassette, said correction tape cassette comprising:

a housing which is made at least in part of plastic material;

a lift-off type correction tape at least partially disposed in said housing;

said housing having a structural formation which is configured to sufficiently match the structural formation on the first type of ribbon cassette to permit said correction tape cassette and the first type of ribbon cassette to be used together in the device; and, said structural formation on said housing being configured to sufficiently mismatch the structural formation on the second type of ribbon cassette to inhibit the use of said correction tape cassette together with the second type of ribbon cassette when placed in the device.

18. A correction tape cassette for use in a system including a device which uses said correction tape cassette and a ribbon cassette selected from a plurality of types of ribbon cassettes comprising at least two types of ribbon cassettes including a first type of ribbon cassette provided with single-strike type ribbon, the first type of ribbon cassette having a bottom with a tab located at a first location, the plurality of types of ribbon cassettes further including a second type of ribbon cassette provided with multiple-strike type of ribbon, the second type of ribbon cassette having a bottom with a tab located at a location different from the first location on the first type of ribbon cassette, said correction tape cassette comprising:

a housing having a top with a surface having an opening, said housing being made at least in part of plastic material;

a correction tape at least partially disposed in said housing, said correction tape being of the lift-off type;

said opening in said surface of said top of said housing being sized, shaped, and positioned to permit the tab on the first type of ribbon cassette to enter said opening in said surface when said correction tape cassette and the first type of ribbon cassette are inserted into the device so as to permit use of said correction tape cassette with the first type of ribbon cassette; and, said surface of said top of said housing being configured to contact the tab on the second type of ribbon cassette when said correction tape cassette and the second type of ribbon cassette are inserted into the device so as to inhibit use of said correction tape cassette with the second type of ribbon cassette.

19. A correction tape cassette for use in a system including a device which uses said correction tape cassette and a ribbon cassette selected from a plurality of types of ribbon cassettes comprising at least two types of ribbon cassettes including a first type of ribbon cassette provided with multiple-strike type ribbon, the first type of ribbon cassette having a structural formation which is accessible from outside the first type of ribbon cassette, the plurality of types of ribbon cassettes further including a second type of ribbon cassette provided with single-strike type ribbon, the second type of ribbon cassette having a structural formation which is accessible from outside the second type of ribbon cassette, the structural formation on the first type of ribbon cassette having at least one difference from the structural formation on the second type of ribbon cassette, said correction tape cassette comprising:

a housing which is made at least in part of plastic material;

a cover-up type correction tape at least partially disposed in said housing;

said housing having a structural formation which is configured to sufficiently match the structural formation on the first type of ribbon cassette to permit said correction tape cassette and the first type of ribbon cassette to be used together in the device; and, said structural formation on said housing being configured to sufficiently mismatch the structural formation on the second type of ribbon cassette to inhibit the use of said correction tape cassette together with the second type of ribbon cassette when placed in the device.

20. A correction tape cassette for use in a system including a device which uses said correction tape cassette and a ribbon cassette selected from a plurality of types of ribbon cassettes comprising at least two types of ribbon cassettes including a first type of ribbon cassette provided with multiple-strike type ribbon, the first type of ribbon cassette having a bottom with a tab located at a first location, the plurality of types of ribbon cassettes further including a second type of ribbon cassette provided with single-strike type of ribbon, the second type of ribbon cassette having a bottom with a tab located at a location different from the first location on the first type of ribbon cassette, said correction tape cassette comprising:

a housing having a top with a surface having an opening, said housing being made at least in part of plastic material;

a correction tape at least partially disposed in said housing, said correction tape being of the cover-up type; and said opening in said surface of said top of said housing being sized, shaped, and positioned to permit the tab on the first type of ribbon cassette to enter said opening in said surface when said correction tape cassette and the first type of ribbon cassette are inserted into the device so as to permit use of said correction tape cassette with the first type of ribbon cassette; and, said surface of said top of said housing being configured to contact the tab on the second type of ribbon cassette when said correction tape cassette and the second type of ribbon cassette are inserted into the device so as to inhibit use of said correction tape cassette with the second type of ribbon cassette.

* * * * *